US008459935B1

(12) United States Patent
Liang

(10) Patent No.: US 8,459,935 B1
(45) Date of Patent: Jun. 11, 2013

(54) TURBINE VANE WITH ENDWALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/445,078

(22) Filed: Apr. 12, 2012

Related U.S. Application Data

(63) Continuation of application No. 11/986,030, filed on Nov. 19, 2007, now abandoned.

(51) Int. Cl.
*F01D 5/18* (2006.01)

(52) U.S. Cl.
USPC ..... 415/115; 416/193 A

(58) Field of Classification Search
None
See application file for complete search history.

(56) References Cited

U.S. PATENT DOCUMENTS

| | | | | |
|---|---|---|---|---|
| 3,800,864 | A * | 4/1974 | Hauser et al. | 415/115 |
| 4,017,213 | A * | 4/1977 | Przirembel | 415/115 |
| 2005/0058545 | A1 * | 3/2005 | Cardenas | 416/97 R |

FOREIGN PATENT DOCUMENTS

JP 11166401 A * 6/1999

* cited by examiner

*Primary Examiner* — Richard Edgar
(74) *Attorney, Agent, or Firm* — John Ryznic

(57) ABSTRACT

Turbine stator vane with endwall cooling that includes a number of impingement chambers that extend around the airfoil perpendicular to a hot gas flow over the endwall, the impingement chambers are connected by rows of near wall cooling channels offset so that impingement cooling occurs within the chambers, some of the impingement chambers are connected by resupply cooling air holes and some of the impingement chambers are connected to film cooling holes.

18 Claims, 3 Drawing Sheets

View A-A

TURBINE VANE WITH ENDWALL COOLING

CROSS-REFERENCE TO RELATED APPLICATIONS

This application is a CONTINUATION of U.S. patent application Ser. No. 11/986,030 filed on Nov. 19, 2007 and entitled TURBINE VANE WITH ENDWALL COOLING.

GOVERNMENT LICENSE RIGHTS

None.

BACKGROUND OF THE INVENTION

1. Field of the Invention

The present invention relates generally to turbine airfoils, and more specifically to a turbine vane with endwall cooling.

2. Description of the Related Art including information disclosed under 37 CFR 1.97 and 1.98

In a gas turbine engine, such as an industrial gas turbine engine, a compressed air from a compressor is passed into a combustor and burned with a fuel to produce a hot gas flow of extreme temperature. The high temperature gas is then passed through a multiple stage turbine where the heat energy is converted into mechanical energy used to drive the compressor and, in the case of an IGT drive an electric generator.

The efficiency of the engine can be increased by passing a high temperature gas flow into the turbine. In the turbine, the first stage stator vanes and rotor blades are exposed to the highest gas temperature. It is these airfoils that limit the turbine inlet temperature (TIT). Other than the material properties of these airfoils, a higher temperature can be used if higher levels of airfoil cooling can be used. However, airfoil cooling is wasted compressed air that lowers the engine efficiency since the compressed air used for cooling typically is bled off from the compressor. It is generally an objective of the design engineer to maximize the amount of cooling capability while at the same time minimizing the amount of cooling air used.

Under-cooling of turbine airfoils, like the endwalls of the stator vanes, can lead to hot spots that cause oxidation or backflow of the hot gas into the internal cooling passages of the airfoils. Both of these problems can severely shorten the life of the turbine airfoil and require excessive down times for the engine. In the case of an IGT, this can be very expensive, since these engines normally have to operate for thousands of hours without stopping.

In the prior art, backside impingement in conjunction with multiple rows of film cooling is used to provide cooling of the endwalls of a high temperature first stage stator vane as seen in FIG. 1. Individual compartments are used on the backside of the endwall for a better control of cooling flow and pressure distribution. Film cooling holes 11 open onto the surface of the suction side airfoil and the inner diameter endwall as seen in FIG. 1. The impingement holes 12 and the separated impingement compartments are shown on the outer diameter endwall in FIG. 1. However, to fit impingement pressure across the impingement holes or post impingement cooling air pressure, each individual compartment still experiences a large main stream pressure to cooling air pressure variation. Also, each impingement compartment has to be designed with a post impingement pressure higher than the maximum main stream hot gas pressure in order to achieve a good back flow margin (BFM) so that the external hot gas will not flow into the cooling holes. Consequently, an overpressure is produced at the lower main stream hot gas pressure location. This over-pressure issue becomes more pronounced at the aft portion of the vane suction side where the endwall is exposed to the maximum main stream variation as well as the maximum ratio of cooling air to hot gas pressure ratio.

Metering down the cooling pressure through the impingement holes extensively in order to obtain the maximum film cooling on the endwall surface may result in a hot gas ingestion problem when some of the impingement holes become plugged by dirt or other debris. As a result of this large compartment cooling construction design, it is difficult to achieve a stream-wise and circumferential-wise cooling flow control for an endwall with a large external hot gas temperature and pressure variation. In addition, a single impingement cooling technique with large impingement cavity to cover a large endwall region is not the best method of utilizing cooling air. The resulting mal-distribution of cooling flow yields a low convection cooling effectiveness.

BRIEF SUMMARY OF THE INVENTION

It is an object of the present invention to provide a turbine vane endwall with improved cooling over the cited prior art vanes.

It is another object of the present invention to provide for a turbine vane endwall with an improved usage of cooling air for a given airfoil inlet gas temperature and pressure profile than that of the cited prior art vanes.

It is another object of the present invention to provide for a turbine vane endwall with a high coolant flow turbulence level that yields a higher internal convection cooling effectiveness than the cited prior art vane.

The turbine vane of the present invention includes endwalls on the inner and outer diameters each with a near wall cooling multi-impingement cavity flow metering and pressure regulation construction along the endwalls. The endwalls include a series of impingement chambers extending across the endwall and generally normal to the hot gas flow over the endwall. A cooling inlet feed hole supplies cooling air to the upstream-most impingement chamber. Adjacent impingement chambers are connected through several near wall cooling channels, with some of the impingement chambers also having film cooling holes to discharge film air onto the endwall surface. Some of the impingement chambers also include re-supply holes to add cooling air to the series of impingement chambers from the impingement cavity downstream from the cooling inlet feed hole. The last impingement chamber includes a discharge slot or slots to discharge cooling air onto the mate face of the adjacent vane endwall. Thus, cooling air flows through the inlet feed holes and into the first impingement chamber to provide impingement cooling to the endwall, then through the near wall cooling channels and into the next impingement chamber, repeating this series until the last impingement chamber discharges the cooling air through the discharge cooling slots. In this series, some of the impingement chambers discharge film cooling air through film holes onto the endwall surface, and some impingement chambers have cooling air added through the re-supply cooling holes to maintain a design pressure and cooling air flow through the impingement chambers. The endwall cooling circuit is used on both inner and outer diameter endwalls of the stator vane.

DETAILED DESCRIPTION OF THE INVENTION

Figure 1:
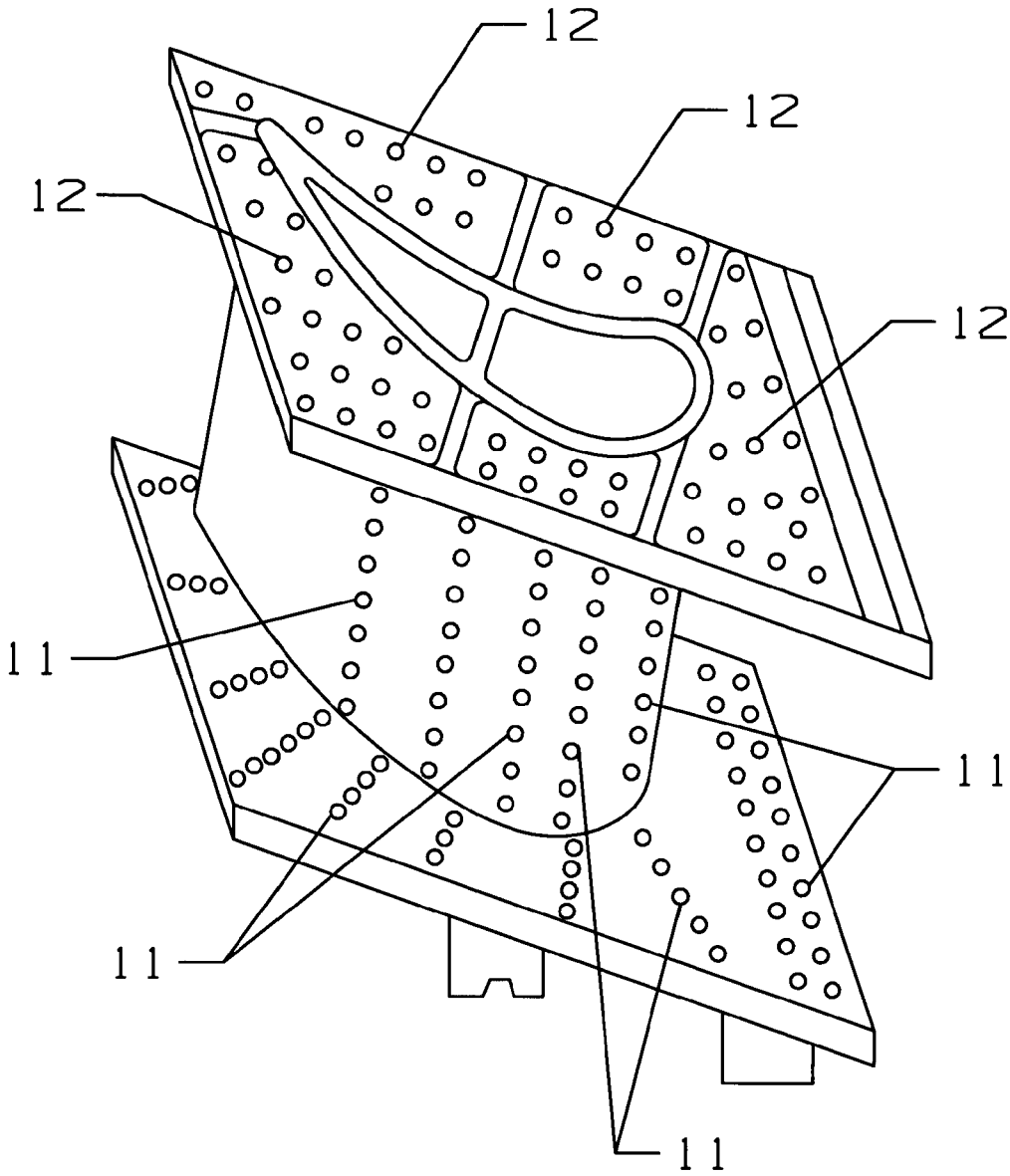
FIG. 1 shows a schematic view of a prior art turbine vane with endwall film cooling holes.
Figure 2:
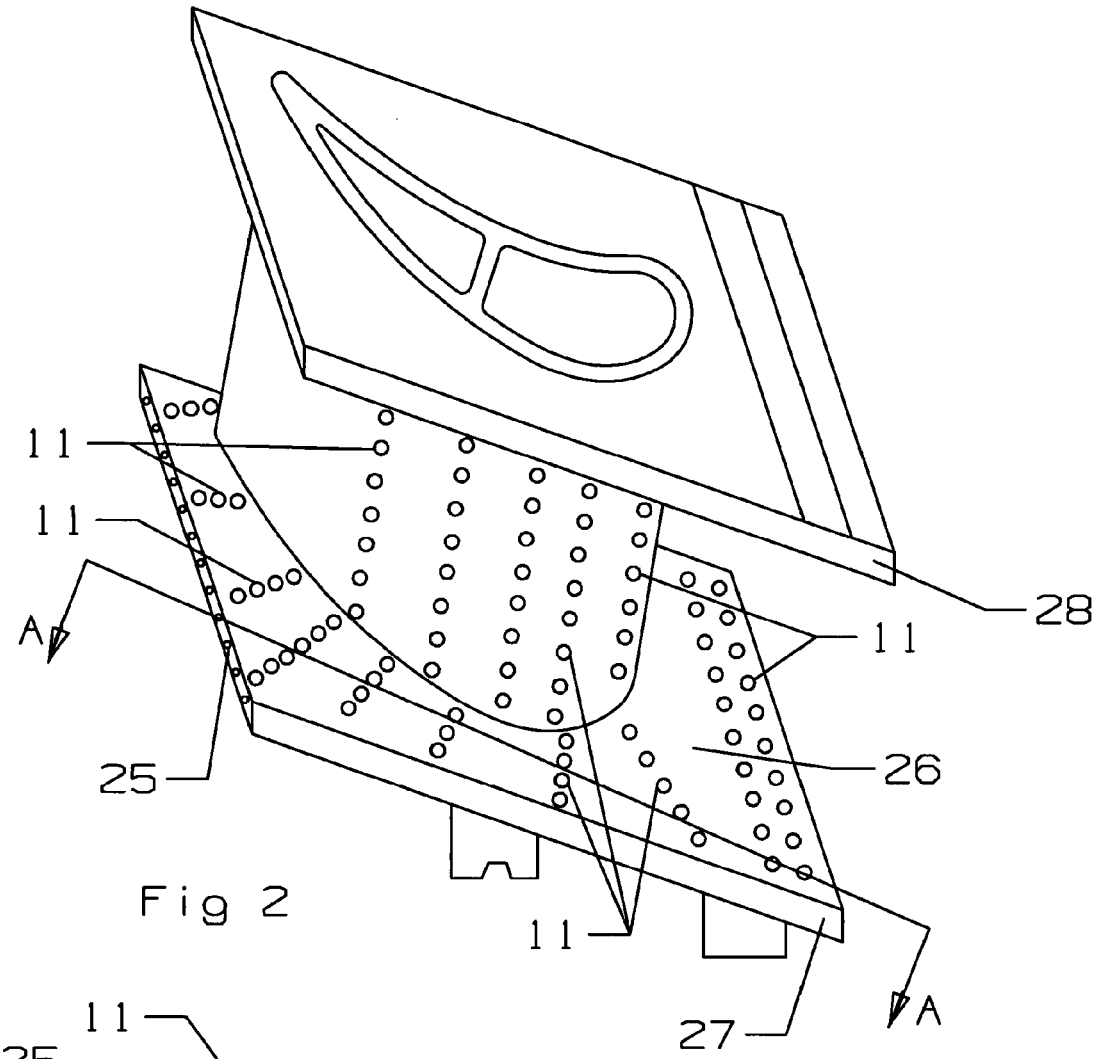
FIG. 2 shows a schematic view of the endwall film cooling arrangement of the vane of the present invention.

FIG. 2 shows the turbine vane with the film cooling hole arrangement opening onto the endwall surface, which is the same arrangement in the prior art vane. The present invention involves the cooling passages within the endwall in which the film cooling holes are connected. The vane includes an outer diameter endwall 28 and an inner diameter endwall 27 both of which have the endwall cooling circuit described below. The vane endwalls experience relatively high pressures at locations upstream from the leading edge of the airfoil and relatively low pressures at locations downstream from the trailing edge of the airfoil.

Figure 3:
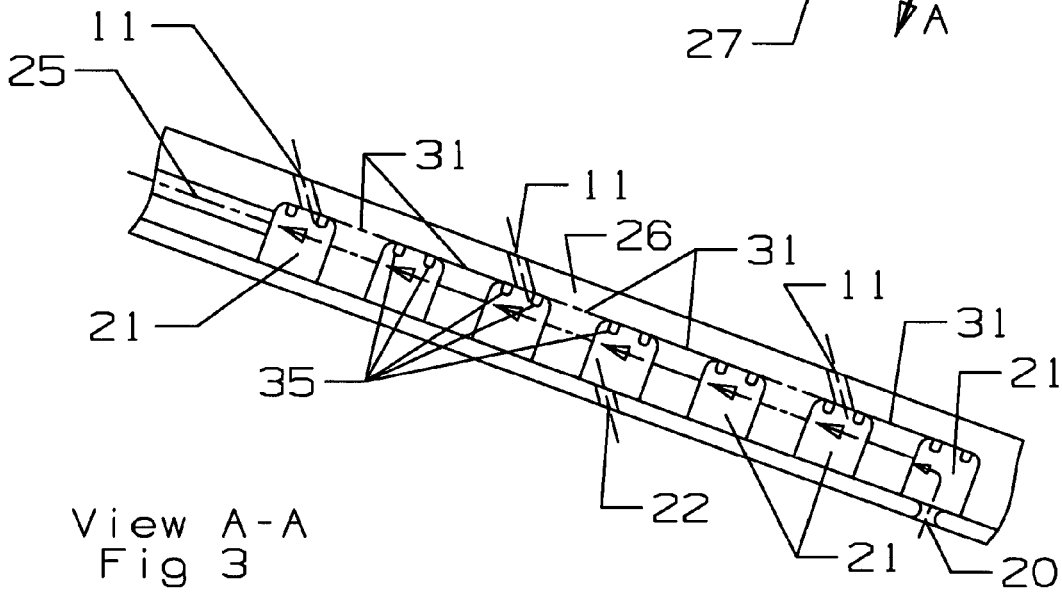
FIG. 3 shows a cross section view of the endwall cooling circuit of the present invention through line A-A in FIG. 2.
Figure 4:
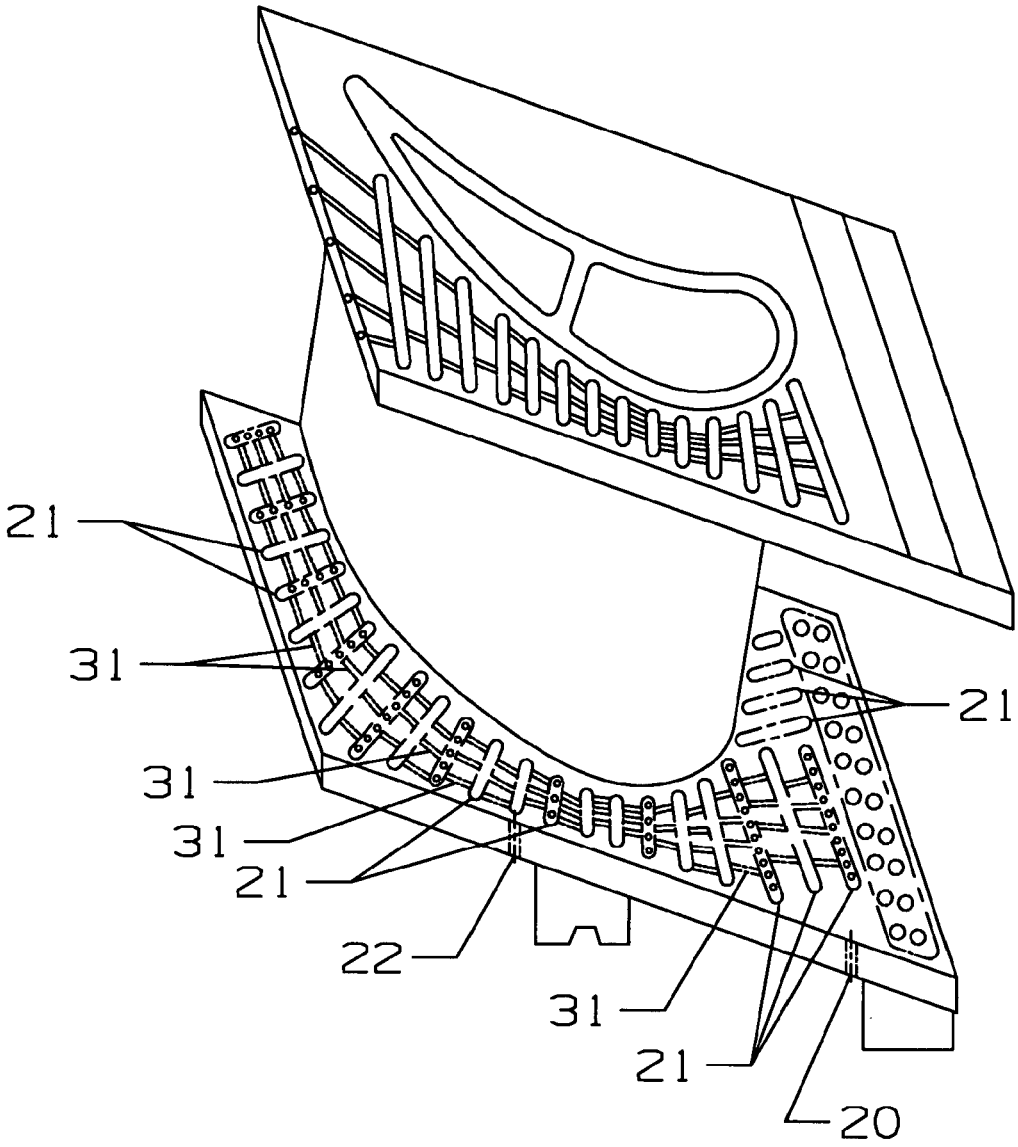
FIG. 4 shows the internal cooling circuit contained within the endwall of the vane of the present invention.

FIG. 3 shows a cross section view of the endwall cooling circuit of the present invention which is taken through the line A-A in FIG. 2. The inner diameter (ID) endwall 27 includes an inner surface exposed to the pressurized cooling air from the supply source and an outer surface having a thermal barrier coating (TBC) applied and exposed to the hot gas flow through the vane. A cooling air feed hole 20 is located on the forward end of the endwall and opens into an impingement chamber 21 that extends just underneath the endwall surface in a direction substantially perpendicular to the hot gas flow over the endwall that produces near wall cooling. A series of these impingement chambers 21 are spaced from each other and extend around the airfoil as seen in FIG. 4. Each impingement chamber 21 includes trip strips 35 (or other turbulators or rough surfaces to promote turbulent air flow) on the upper surface of the impingement chamber closest to the endwall outer surface as seen in FIG. 3. The trip strips 35 extend from the impingement chamber wall and into the chamber at around 90 degrees from the direction of the impingement cooling air leaving the near wall cooling channels 31 as seen in FIG. 3. By 90 degrees, the direction of the impingement air from the near wall cooling channels is parallel to the surface of the impingement chamber from which the trip strips extend from.

As seen in FIG. 4, the impingement chambers 21 extend around both sides of the airfoil and from near the upstream end of the endwall to the downstream end. Also, adjacent impingement chambers 21 are substantially parallel as the chamber bend around the airfoil. The impingement chambers 21 also extend from near the airfoil to near the edge of the endwall. The impingement chambers 21 are sized and located around the endwall to provide the most effective cooling for the endwall surface. Two rows of ordinary film cooling holes are arranged along the upstream end of the endwall and upstream from the first impingement chamber as seen in FIG. 4. However, the rows of ordinary film cooling holes can be eliminated and replaced with impingement chambers and near wall cooling channels linking the remaining downstream impingement chambers.

The adjacent impingement chambers 21 are connected by a plurality of near wall cooling channels 31. The impingement chambers 21 have a larger diameter than the near wall cooling channels 31 in order to produce impingement cooling, and because they are impingement chambers they also produce diffusion of the cooling air. As seen in FIG. 3, some of the impingement chambers 21 include a plurality of film cooling holes 11 that open onto the outer endwall surface to discharge film cooling air. Also, some of the impingement chambers 21 include a plurality of refresh cooling air supply holes 22 or re-supply cooling holes that connect to the lower surface of the endwall and the compressed air cooling source to supply makeup or refresh air to the series of impingement chambers 21. The film cooling holes 11 are located in the appropriate impingement chambers to provide film cooling onto the endwall surface at the desired locations. The re-supply cooling air holes 22 are located in the appropriate impingement chambers to supply enough cooling air to maintain the pressure and flow requirements for the endwall cooling circuit. At the end of the last impingement chamber 21 is a plurality of trailing edge discharge cooling slots 25 or holes that discharge the cooling air from the endwall cooling circuit.

The impingement chambers 21 that have film cooling holes have the near wall cooling channels offset from the film holes in order to enhance the impingement cooling effect within the impingement chambers 21. Also, the inlet near wall cooling channels are offset from the outlet near wall cooling channels within the impingement chamber so that the cooling air does not pass straight through the impingement chamber from the inlet to the outlet near wall cooling channel. However, this does not have to be the case for all of the near wall cooling channels since the space may not allow for the non-alignment or offsetting. The same problem may occur with the film cooling holes having to be aligned with some of the near wall cooling channels because of limited space within the impingement chamber.

The inner diameter endwall 28 also includes an endwall cooling circuit as described above with impingement chambers spaced around the airfoil on the endwall and feed holes and re-supply holes to pass cooling air into the cooling circuit. Film cooling holes are connected to certain ones of the impingement chambers to discharge film cooling air.

In operation, the cooling air is supplied through the forward section of the endwall where the external heat load and pressure is relatively high. Cooling air is then injected through the cooling air feed holes 20 and into the impingement chamber 21 at the leading edge location first for the cooling of the endwall high heat load and pressure region. This cooling air is then injected into a series of near wall cooling channels 31 and impingement chambers 21 through an inter-linked arrangement to form the cooling flow circuit for the endwall extending from the endwall leading edge toward the endwall trailing edge. The inter-linked multiple near wall cooling channels and impingement chambers provide for a long flow path for the coolant parallel to the stream-wise direction of the gas path pressure and temperature profiles. In general, these multiple near wall cooling channels and impingement chambers create high coolant velocities and high internal heat transfer coefficient while the long flow path creates large cooling side to gas side convective area ratio and therefore yields a high overall cooling effectiveness. The injection process for the cooling air repeats throughout the entire inter-linked near wall cooling channels and impingement chambers, cascade metering down the cooling flow pressure trailing to the mainstream gas side pressure and heat load, and then bleed off from the individual impingement chamber to provide maximum film cooling for the endwall surface. Cooling air from the last impingement chamber is discharged through multiple small cooling slots to provide endwall trailing edge cooling.

The multiple near wall cooling channels and multiple impingement chambers are designed based on endwall gas side pressure distribution in both stream-wise and circumferential-wise directions. In addition, each individual impingement chamber can be designed based on the endwall local external heat load to achieve a desired local metal temperature level. This is achieved by means of varying the interconnecting near wall cooling channel's velocity and pressure level within the impingement chamber with different pressure ratio across the near wall cooling channels. As a result of this design, the cooling flow and pressure ration across the film cooling holes can be regulated to the local heat load and hot gas pressure conditions. The near wall cooling channel can be designed as a long length to hydraulic diameter ratio channel or as multiple short cooling channels to regulate the cooling flow and pressure by the use of continuous cascade metering mechanism. Trip strips can be incorporated into the inner walls of the near wall cooling channels as well as the impingement chambers to further augment the internal heat transfer performance.

In addition, fresh cooling air at higher coolant pressure can be induced into any of the impingement cooling chambers by means of inducing the fresh cooling air inline with the impingement flow or induced at the bottom center of the impingement chamber at an angle to the cooling flow exit from the near wall cooling channel. This cooling design will yield a lower mixed cooling air temperature and re-energize the stream-wise velocity within the impingement chamber for the enhancement of internal heat transfer coefficient to achieve a better local cooling.

I claim:

1. An air cooled turbine stator vane comprising:

an endwall forming a hot gas flow path through the vane;

the endwall including a hot gas flow side and an impingement cooling air side;

a plurality of separated impingement and diffusion chambers formed within the endwall and located adjacent to the hot gas flow side such that near wall cooling occurs when cooling air passes through the impingement chambers;

adjacent impingement and diffusion chambers being substantially parallel to each other as the impingement chambers extend around the airfoil of the vane;

a plurality of cooling air inlet feed holes connecting an upstream one of the plurality of impingement and diffusion chambers to a cooling air supply; and, a plurality of near wall cooling channels connecting adjacent impingement and diffusion chambers, the near wall cooling channels being located adjacent to the hot gas flow side of the endwall to provide near wall cooling to the endwall.

2. The air cooled turbine stator vane of claim 1, and further comprising:

some of the impingement and diffusion chambers each including a plurality of film cooling holes to discharge film cooling air onto the endwall hot gas flow side.

3. The air cooled turbine stator vane of claim 2, and further comprising:

some of the impingement and diffusion chambers each including a plurality of refresh cooling air supply holes; and, the impingement and diffusion chambers having a film cooling hole do not have a refresh cooling supply hole.

4. The air cooled turbine stator vane of claim 1, and further comprising:

the impingement and diffusion chambers extend around the pressure side and the suction side of the airfoil.

5. The air cooled turbine stator vane of claim 1, and further comprising:

the plurality of cooling air inlet feed holes is connected to the upstream-most impingement and diffusion chamber.

6. The air cooled turbine stator vane of claim 1, and further comprising:

the downstream-most impingement and diffusion chamber includes a trailing edge discharge cooling slot to discharge cooling air from the impingement and diffusion chamber out the edge of the endwall.

7. The air cooled turbine stator vane of claim 2, and further comprising:

most of the near wall cooling channels are staggered from the film cooling holes of the associated impingement and diffusion chamber so that impingement cooling within the impingement and diffusion chamber is enhanced.

8. The air cooled turbine stator vane of claim 1, and further comprising:

in some of the impingement and diffusion chambers, the inlet near wall cooling channels are offset from the outlet near wall cooling channels in order reduce straight through flow of the cooling air within the impingement chamber.

9. The air cooled turbine stator vane of claim 1, and further comprising:

the impingement and diffusion chambers extend from near the airfoil to near the edge of the endwall.

10. The air cooled turbine stator vane of claim 1, and further comprising:

the stator vane is a first stage stator vane in an industrial gas turbine engine.

11. The air cooled turbine stator vane of claim 1, and further comprising:

the impingement and diffusion chambers include turbulent promotion means on the upper surface and generally inline with the near wall cooling channels.

12. The air cooled turbine stator vane of claim 11, and further comprising:

the impingement cooling air flow from the near wall cooling channels is substantially parallel to the wall surface of the impingement and diffusion chamber from which the turbulent promotion means extends from.

13. A process for near wall cooling an endwall of a turbine stator vane used in a gas turbine engine, the process comprising the steps of:

passing pressurized cooling air into an impingement and diffusion chamber located on an upstream side of the endwall;

passing the pressurized cooling air through a series of near wall cooling channels and impingement and diffusion chambers to provide near wall cooling and impingement cooling to the endwall; and, discharging film cooling air onto the endwall hot gas side surface from at least some of the impingement and diffusion chambers.

14. The process for near wall cooling an endwall of claim 13, and further comprising the step of:

promoting turbulent flow of the cooling air within the impingement and diffusion chambers.

15. The process for near wall cooling an endwall of claim 13, and further comprising the step of:

supplying fresh cooling air to some of the impingement and diffusion chambers.

16. The process for near wall cooling an endwall of claim 15, and further comprising the step of:

supplying the fresh cooling air to impingement and diffusion chambers that do not discharge film cooling air.

17. The process for near wall cooling an endwall of claim 16, and further comprising the step of:

discharging the cooling air from the last impingement and diffusion chamber onto an edge of an adjacent vane endwall.

18. The process for near wall cooling an endwall of claim 15, and further comprising the step of:

supplying an amount of refresh cooling air substantially equal to the discharge of film cooling air.

* * * * *